United States Patent [19]

Moomey

[11] 3,988,871

[45] Nov. 2, 1976

[54] SUSPENDED CEILING CONSTRUCTION

[76] Inventor: Henry Moomey, 4693 Marshall, S.E., Kentwood, Mich. 49508

[22] Filed: Feb. 3, 1975

[21] Appl. No.: 546,309

Related U.S. Application Data

[63] Continuation-in-part of Ser. No. 407,802, Oct. 9, 1973, Pat. No. 3,863,413.

[52] U.S. Cl. ..... 52/484; 52/488; 52/496

[51] Int. Cl.² ..... E04B 5/55

[58] Field of Search ..... 52/484, 489, 496, 127, 52/488

[56] References Cited

UNITED STATES PATENTS

| | | | |
|---|---|---|---|
| 2,993,240 | 7/1961 | Ericson | 52/496 X |
| 3,589,086 | 6/1971 | Schilling | 52/496 X |
| 3,863,413 | 2/1975 | Moomey | 52/489 X |

*Primary Examiner*—Frank L. Abbott
*Assistant Examiner*—Carl D. Friedman
*Attorney, Agent, or Firm*—McGarry & Waters

[57] ABSTRACT

A suspended ceiling construction comprises a plurality of individual ceiling tiles suspended in rows between evenly spaced support beams. Each tile has a kerfed back edge that fits over a flange on a back support beam and an L-shaped front portion having a lower lip that fits under a flange on a front support beam. The side edges of each ceiling tile include longitudinal kerfs therein extending rearwardly from the front portion of the tile, with the kerfs being positioned above the lip on the front portion of the tile by a distance at least equal to the thickness of the flange on the front support beam. Tile supporting splines fit into the kerfs in the sides of abutting ceiling tiles and engage the front support beams. At least one of the ceiling tiles is an access tile and comprises cut away portions above the kerfs on each side of the tile. The splines include a movable member slidable from a locking position, engaging the kerfs at the side edges of the tiles, to a release position at the cut away section. The movable member has a flange sized to pass through the opening at the cut away portion such that the splines in that tile may fit through these open sections when the splines are in their release positions. These open sections permit the removal of the tiles from the ceiling for access to the space above the suspended ceiling.

12 Claims, 7 Drawing Figures

SUSPENDED CEILING CONSTRUCTION

CROSS-REFERENCE TO RELATED APPLICATIONS

This application is a continuation-in-part of my copending U.S. patent application Ser. No. 407,802, filed Oct. 9, 1973, now U.S. Pat. No. 3,863,413.

BACKGROUND OF THE INVENTION

1. Field of the Invention

This invention relates to a suspended ceiling construction. In one of its aspects the invention relates to a suspended ceiling construction having a concealed support structure and access tiles removable by sliding locking splines from locking to release position.

2. State of the Prior Art

Suspended ceilings are well known. In most typical suspended ceiling structures, evenly spaced suspension beams or support members are suspended from the ceiling or other structural members of the enclosure, and individual ceiling tiles of a given size are suspended between adjacent support members. The support members may be concealed or visible from a position below the ceiling structure, with the concealed support structures involving more complex structural problems than ceilings with visible supports.

Two of the most common types of suspended ceilings in use today are T-Bar and Z-Bar type structures. In a T-bar grid structure, the support structure comprises a rectangular grid or matrix of inverted T-shaped members or T-bars suspended from the ceiling. The T-bar structure may be visible or concealed, depending on the ceiling tiles mounted in the grid. A visible T-bar system is called a "conventional grid" system, while a concealed T-bar system is called a "concealed grid" system.

In a conventional grid system, individual ceiling tiles rest on the upper surfaces of the horizontal flanges of the T-bars. In this type of construction, access to the space above the ceiling is provided by lifting the tiles upwardly out of the gridwork.

One problem with this type of system is that the flanges on the T-bars are fully visible from below the ceiling, thus impairing the aesthetic qualities of the ceiling and making it necessary to employ finished metal in the T-bars so that the visible portions will be as unobtrusive as possible.

Another problem with a conventional grid system is that the ceiling tiles must be lifted upwardly to gain access to the space above the suspended ceiling. This upward removal requires extra clearance between the suspended ceiling and any structure or ductwork above the suspended ceiling. Three inches of clearance may be necessary for reasonable access. In cases where this extra clearance is not possible or is omitted through poor installation procedures, it is quite difficult to gain access to the space above the tiles.

In concealed grid T-bar structures, the tiles have a kerf in the outside edges thereof and the tiles are fitted over the edges of the horizontal flanges on the T-bars. The grid members are concealed with this type of system, but the tiles are not removable and must be broken to gain access to the space above the suspended ceiling.

In a Z-bar type of structure, the support structure for the suspended ceiling is formed of evenly spaced parallel support members called Z-bars, which typically are suspended from C-shaped channel members (typically 1½ inch channel members) that are spaced evenly across the entire width of a room and run in a perpendicular direction with respect to the Z-bars. The channel members are suspended from the ceiling by suspension wire, and the Z-bars are suspended from the channel members by spring wire clips. The Z-bars are similar in cross sectional configuration to the T-bars of a concealed grid structure in that the Z-bars have a vertical support member with horizontal flanges extending outwardly from the bottom in an inverted T-shaped member. However, the Z-bars also have a horizontal flange extending outwardly from the top of the vertical support member, thus giving the member a roughly Z-shaped cross section. The flange at the top is designed to engage spring clips that hold the Z-bar to the transverse channel members.

The ceiling tiles conventionally employed in a Z-bar structure are 12-inch square tiles, with each tile having a continuous kerf in the side running around the entire tile. The kerf on the back edge of the tile fits over a flange on a back Z-bar, and the kerf on the front edge of the tile fits over a flange on a Z-bar in front of the tile, with the front Z-bar being fitted into position after a row of tiles has been fitted into engagement with the flange on the back Z-bar. "Breather splines," or thin metal plates, are inserted in the kerfs in side edges of adjacent tiles, in order to close the slots between the tiles and eliminate air flow through the slots.

One of the principal advantages of Z-bar ceilings is that the support structure is completely invisible when the ceiling is installed, and this is a very desirable feature. Accordingly, this type of ceiling has been installed in a high percentage of suspended ceiling installations over the past few years.

One of the principal drawbacks with a Z-bar type of ceiling structure is that, like a concealed grid T-bar ceiling, once the ceiling is installed, the tiles are permanently locked in place, and there is no way to gain access to the space above the ceiling without breaking and destroying a number of tiles. Reassembly of the ceiling structure after access has been provided similarly is a difficult task. Since it is important in many installations that access be provided to the space above the suspended ceiling (e.g., for repair or maintenance of lights, air conditioning, electric wiring or other utilities), the inaccessability of Z-bar ceiling structure is a serious deficiency with this type of system.

In order to overcome the problems of inaccessability of suspended ceilings having a concealed support structure, some attempts have been made to design removable access tiles for existing concealed grid T-bar and Z-bar systems, and other attempts have been made to develop new types of ceilings having access tiles. The problems with the access tiles for ceilings having concealed grids have been that the access tiles have been too complex and have employed expensive and complicated clips for holding the tiles in place. In addition, even with workable access tiles, convenient access to the space above the ceiling is still limited to the space immediately above each access tile, and other tiles still have to be broken away to provide an enlarged access area or access to areas where special access tiles are not located.

One of the principal problems with other types of ceiling structures having access tiles is that they do not employ Z-bar ceiling or T-bar support structures but employ special ceiling supports designed especially for that particular ceiling. Hence, in the vast majority of existing installations, wherein Z-bar or T-bar support structures are already in use, it would be necessary to remove and discard the entire support structure in order to switch over to a new type of ceiling. Other problems with these other types of ceiling structures are that they frequently are difficult to install and remove.

The present invention obviates the foregoing deficiencies in the prior art and provides a simple and inexpensive suspended ceiling construction having concealed support members and simple downwardly removable access tiles that may be suspended from either a Z-bar or a T-bar support structure.

SUMMARY OF THE INVENTION

In accordance with the present invention, a suspending ceiling construction having concealed support members that is simple and easy to construct, yet provides easy access to the space above the ceiling, comprises a plurality of evenly spaced, coplanar, parallel support beams suspended from the ceiling, and a plurality of removable ceiling tiles suspended in rows between each pair of spaced first and second support beams.

Means releasably support one end of the ceiling tiles on the first support beam, each of the tiles having kerfs along opposite edges thereof extending between the first and second support beams. Spline means in the kerfs extend between adjacent tiles and engage the second support beam so that the tiles are supported at an opposite end through the spline. At least one of the tiles is an access tile and is cut away above the kerf along a portion of each side, thereby forming an opening above the kerf.

The spline means adjacent the access tile includes a movable member slidable between a locking position engaging the kerf at the side of one tile and a release position at the cut away portion of the one tile. The movable member has a flange sized to pass through the opening when the movable member is in release position to permit the one tile to be removed from the ceiling when the movable members are moved to the release position at each side of the tile.

The parallel support members can be the T-bar or Z-bar or L-shaped support structures. Preferably, the tiles have in the one end a kerf which receives a flange of the first support member. The cut away portion of the side kerfs desirably is near the end of the tile. The tiles preferably have a lip at the opposite end which abuts and at least partially conceals the second support means.

In one embodiment, the spline comprises an L-shaped flange which engages the second support means and projects into the kerf of the tile adjacent to the access tile. The movable member is slidably mounted on the L-shaped spline and has a laterally extending flange which extends into the kerf at the side of the access tile.

In another embodiment, the spline includes a bar supported between the first and second support beams and the movable member is slidably supported on the bar. A laterally projecting flange extends from each side of the movable member into a kerf of the access tile and a tile adjacent thereto.

One of the important advantages of the ceiling construction is that conventional or pre-existing Z-bar or T-bar support systems can be used, yet the ceiling has none of the drawbacks of Z-bar or T-bar systems. The support structures are fully concealed but are easily removable in a downward direction to provide maximum access to the space above the ceiling. Because the access tiles are removable downwardly, (in contrast with the upward access of conventional grid systems) the suspended ceiling of the present invention can be placed immediately adjacent to the structure or ductwork above the ceiling without impairing the removability of the tiles or access to the space above the tiles.

Another advantage of the ceiling construction of the present invention is that the tiles and splines themselves are simple and inexpensive and easy to form, and the ceiling is easy to assemble and disassemble. The ceiling tiles may be formed of any conventional ceiling tile material, and the various cuts and removed sections of the tiles are easily formed by conventional manufacturing methods. Likewise, the splines are relatively simple in construction. The support along the entire length of the non-access tiles prevents sagging of the tiles in the event of extreme moisture or heat, such as with a fire.

These and other advantages and features of the present invention will hereinafter appear and, for purposes of illustration, but not of limitation, a preferred embodiment of this invention is described in detail below.

DESCRIPTION OF PREFERRED EMBODIMENTS

Figure 1:
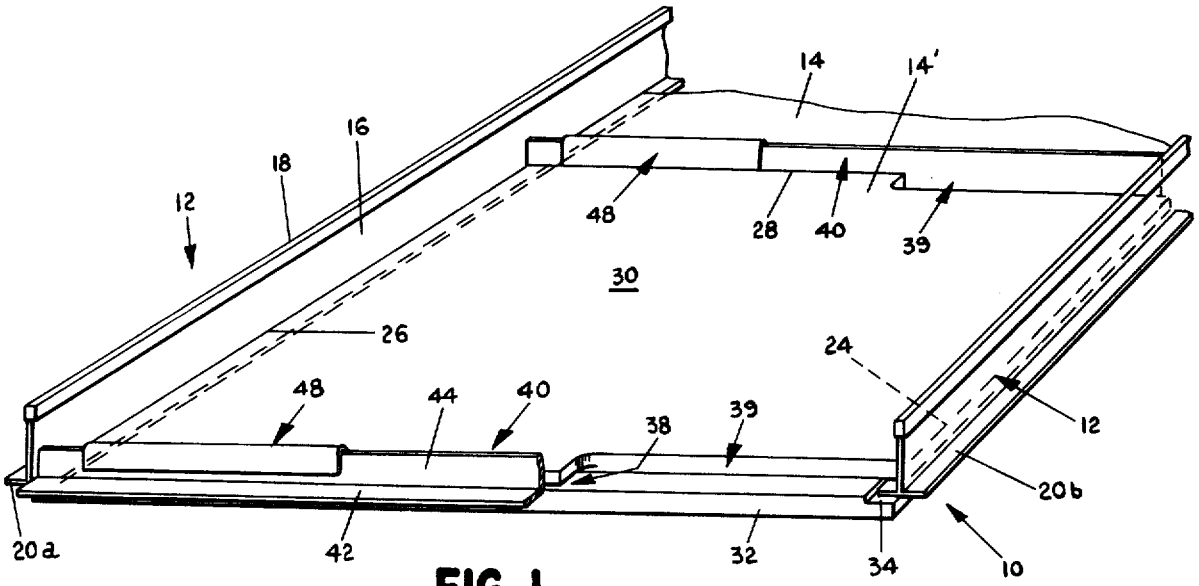
FIG. 1 is a broken perspective view of a section of the suspended ceiling construction of the present invention.

Referring now to the drawings, and to FIGS. 1 – 4 in particular, a suspended ceiling construction 10 comprises a plurality of inverted T-shaped parallel support beams 12 suspended from the structure in which the suspended ceiling is being mounted (e.g., from a fixed ceiling 11), and a plurality of removable ceiling tiles 14 suspended between adjacent parallel support beams. As shown in FIG. 1, ceiling tiles 14 are suspended between adjacent support beams in even rows. For purposes of illustration, a single row will be described herein, with the adjacent support beams being identified as a front support beam **12*a* and a rear support beam 12*b*. Similarly, references to forward and rearward directions shall mean toward the left and right, respectively, as viewed in FIG. 3. The tiles are mounted in abutting relationship along the side edges thereof and extend from one side of the structure to the other. Each support beam 12 is formed of a rigid, light weight metal and comprises a vertical support member 16 having an enlarged rectangular runner 18 at the top thereof and horizontal front and rear flanges 20*a*** and 20*b*, respectively, extending laterally from each side of the bottom thereof.

Support beams 12 typically are suspended from the ceiling 11 by means of cables 22 which are fastened to the ceiling and pass through openings (not shown) in vertical support members 16. It should be recognized that there are any number of different methods for suspending support beams from structural members, and any of these methods would be satisfactory means for suspending the support beams of the present invention.

Ceiling tiles 14 are rectangular or square in shape and have a substantially flat back edge 24, the upper portion of which is relieved slightly to accommodate vertical member 16, a stepped or L-shaped front portion 26, and opposed side edges 28. Each tile comprises parallel flat top and bottom surfaces 30 and 32, respectively. Typically, in a T-bar construction, the tiles will be double tiles, as illustrated, that is, 2 feet long and 1 foot wide, while 1-foot square tiles (not shown) generally are used in Z-bar construction.

The back edge of each ceiling tile 14 is provided with a kerf or groove 34 between the top and bottom of the ceiling tile. This groove extends longitudinally the entire width of the tile and receives the front flange 20*a* of rear support beam 12*b*. The back edge 24 of ceiling tile 14 thus is releasably supported by support beam 12*b* and conceals front flange 20*a* from view.

The front portion 26 of ceiling tile 14 is L-shaped and comprises a lower lip or flange 36 that extends outwardly below rear flange 20*b* on front support beam 12*a*, thus concealing it from view. The ceiling tile is cut away and open above flange 20*b*, so that the ceiling tile requires an additional support to hold the front of the ceiling tile in place against the front support beam.

The sides of ceiling tile 14 are provided with longitudinal kerfs or grooves 38 that extend from the front portion of the tile rearwardly toward the back edge of the tile. Kerfs 38 are positioned in the sides of the tile above the top of lower lip 36 by a distance at least equal to the width of flange 20*b*. The kerfs could conceivably be placed at other elevations.

Figure 2:
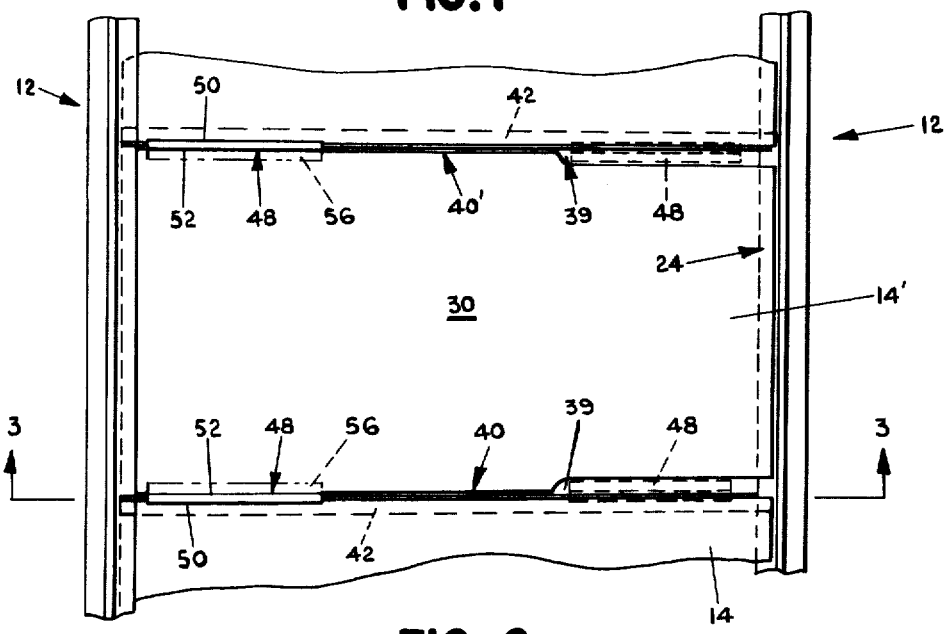
FIG. 2 is a top plan view of a portion of the suspended ceiling construction of the present invention.

As seen in FIGS. 1 and 2, the access tile 14′ has a cut-away portion 39 above the kerfs 38 at each side of the tile, thereby forming an opening above each of the kerfs. The cut-away portions are shown along the back portion of the access tiles 14′ and adjacent to the rear support beam 12*b*.

The tiles are supported at the front end adjacent to the front support beam 12*b* through spline means which extend into the kerfs 38 in each of the adjacent tiles and also supportingly engage the front beam 12*a*. In the embodiment illustrated in FIGS. 1 through 4, the spline means comprises an L-shaped spline 40 having a laterally extending lower portion 42 which projects into the kerf 38 of each tile 14, an upright portion 44 and a longitudinal groove 46 along the length of the upright portion 44. One end of the L-shaped spline 40 extends over the front edge of the flange 20*b* of the front support member 12*a* and the other end extends back to the leading edge, but not over, the flange 20*a* of the rear support beam 12*b*. If desirable, the L-shaped splines can extend partially over the flange 20*a* of the rear support beam 12*b* (as shown by splines 40′ in FIG. 2).

A movable locking spline 48 is slidably mounted on the L-shaped spline 40 and includes an inverted guide flange 50, an upright portion 52 with an indentation 54, and a laterally extending portion 56. The indentation 54 fits within the longitudinal groove 46 of the spline 40 so that the locking flange 48 is slidably retained on the L-shaped spline 40. The laterally extending portion 56 of the locking spline 48 extends into the kerf 38 of the access tile 14′. The length of the laterally extending portion 46 is shorter than the length of the cut-away portion 39 of the access tile 14′ and has a width slightly greater than the kerf so that the portion 46 can be engaged by a disengaging tool.

Figure 3:
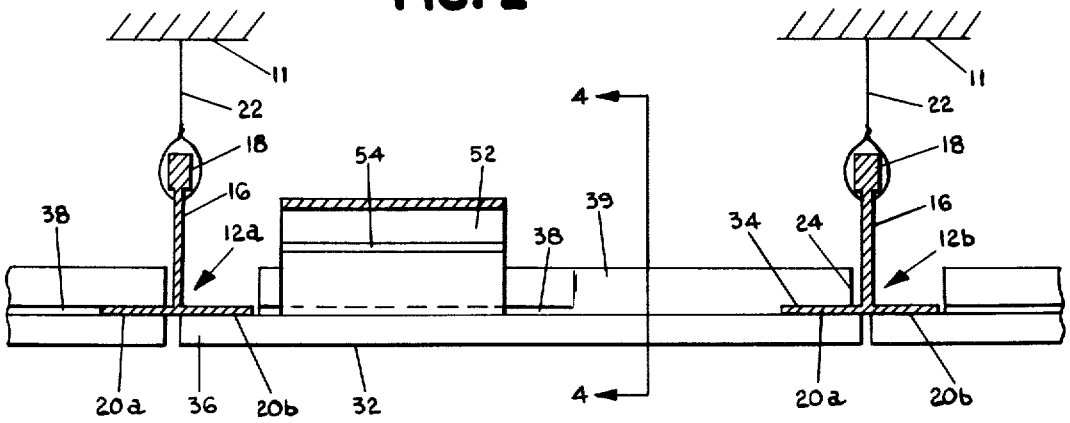
FIG. 3 is a broken sectional side view of the suspended ceiling construction of the present invention, showing the ceiling tiles suspended from a concealed grid support structure.

When the locking spline 48 is in the position illustrated in FIGS. 2 and 3, the access tile 14′ is locked to the adjacent tile 14 through the locking spline 48. The access tile 14′ and the adjacent tiles 14 are both supported at the front end by the front support beam 12*a* through the L-shaped spline 40 which fits over the flange 20*b* of the front support beam 12*a* and through the locking spline 48. The locking spline 48 is movable along the L-shaped spline 40 to a rear portion at which the laterally extending portion 56 of the locking spline 48 is positioned beneath the cut-away portion 39 of the access tile 14′. When each of the locking splines 48 is moved rearwardly adjacent the rear support beam 12*b* as illustrated in phantom lines in FIG. 2, the access tile will no longer be supported at the side and will drop, forward end first, from the ceiling. The access tile 14′ is then gently pulled forward out of engagement with the rear support beam 12*b* and removed. The remainder of the tiles 14 in the line can then be removed merely by removing the L-shaped spline from engagement with the front support beam 12*a* and then sliding the tiles sideways into the open access space to disengage the sides of the tiles 14 from their engagement with the splines from opposite sides of the access opening. In this connection, it should be noted that the two L-shaped splines can be used in back-to-back relationships between two nonaccess tiles.

Thus, the locking splines 48 are slidable from a locking position whereby the access tiles are supported through the spline means to a release position at the cut-away portions 39 of the access tiles 14′ to permit the access tiles to be removed from the ceiling.

Figure 7:
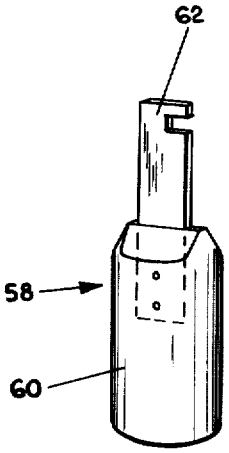
FIG. 7 is a perspective view of a disengaging tool employed with the suspended ceiling construction of the invention.

The locking splines are movable with a knife or any suitable tool which is inserted between access tile 14′ and the adjacent tile 14. A suitable device for moving the locking splines 48 is illustrated in FIG. 7 to which reference is now made. A disengaging tool 58 has a handle 60 with a hooked end 62 for engaging the front or back edge of the locking spline 48. If desirable the locking spline 48 can have a slot (not shown) between the upright portion 52 and the laterally extending portion 56 for receiving the hooked end 62 of the disengaging tool 60.

Figure 5:
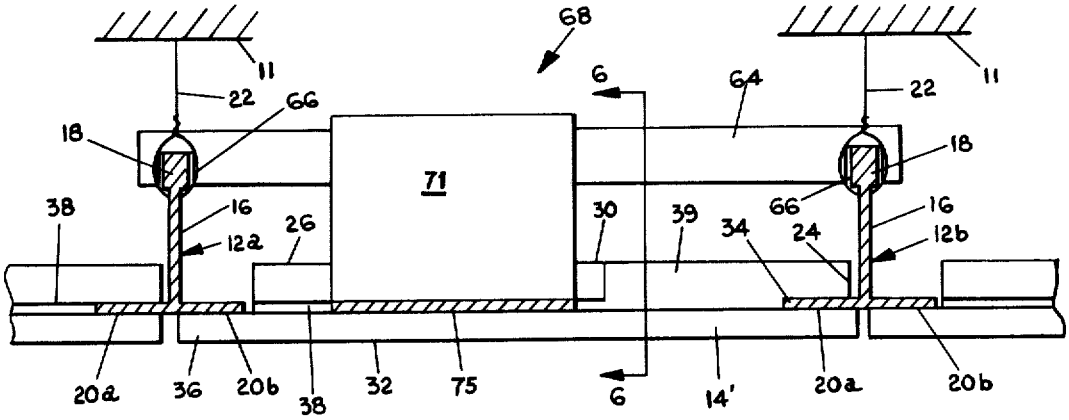
FIG. 5 is a broken sectional side view like FIG. 3 but showing a second embodiment of the invention.
Figure 4:
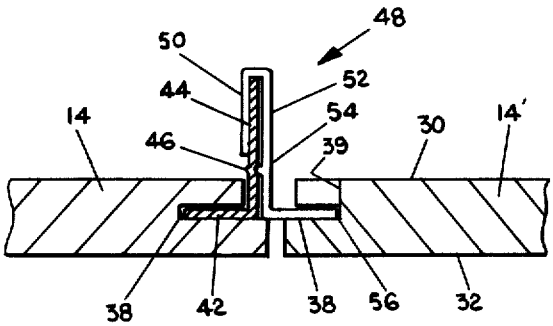
FIG. 4 is a partial sectional taken along lines 4—4 of FIG. 3.
Figure 6:
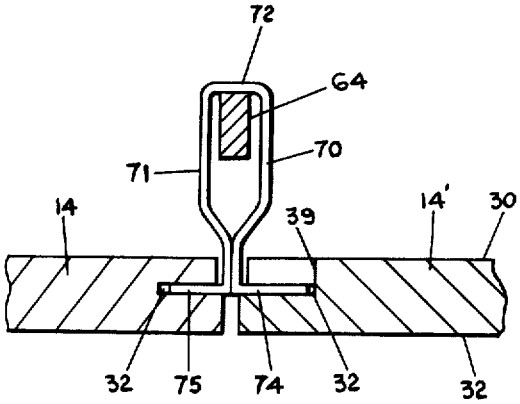
FIG. 6 is a sectional view taken along lines 6—6 of FIG. 5.

Reference is now made to FIGS. 5 and 6 for description of the second embodiment of the invention. In this embodiment, like numerals have been used to designate like parts. Briefly, the tile construction of this embodiment is the same as that of the first embodiment. For purposes of brevity, a description of the tiles and the supporting structure will not be repeated herein.

The spline means of the second embodiment includes a bar 64 having downwardly opening slots 66 which fit over the rectangular runners 18 of the front and rear support beams 12*a* and 12*b*. As illustrated in FIG. 6, the bars are positioned in the vertical plane which separates the adjacent tiles 14 and 14′. The spline means further include a movable member, locking spline 68, which is slidable between a locking position illustrated in FIG. 5 and a release position (not shown) to the right as viewed in FIG. 5 adjacent to the rear support beam 12*b*. The locking spline 68 is formed by parallel depending legs 70 and 71 which are joined at a top portion by a web 72. These legs come together at a bottom thereof and extend outwardly, forming kerf engaging flanges 74 and 75.

When the locking spline is in the position illustrated in FIG. 5, the outwardly extending flanges 74 and 75 engage the kerfs 38 of the access tile 14' and the adjacent tile 14. The tiles are thus supported through the locking spline 68 and the bar 64. When the locking spline 68 is moved to the right as viewed in FIG. 5, the outwardly extending flange 74 is positioned beneath the cut-away portion 39 of the access tile 14'. When the locking splines on each side of the access tile 14' are positioned in this release position, then the access tile 14' will not be supported at the side and will drop front end first from its position illustrated in the drawings. The access tile 14' can then be removed by pulling it forward out of the engagement with the flange 20*a* of the rear support beam 12*b*.

In order to provide maximum ease of assembly and access to the space above the ceiling tiles, it is desirable that each row of tiles include at least one access tile. Preferably, every other tile is an access tile, so as to permit free access to the space above the ceiling structure at any of the number of positions.

Whereas the invention has been described with reference to a T-bar grid support system, the invention is useful in other types of grid support systems. Such other grid support systems include the conventional Z-bar system.

Reasonable variation and modification are possible within the scope of the foregoing disclosure without departing from the spirit of the invention which is defined by the appended claims.

The embodiments of the invention in which an exclusive property or privilege is claimed are defined as follows:

1. A suspended ceiling construction for buildings comprising:

first and second parallel support beams suspended from a structural ceiling within said building;

a plurality of ceiling tiles suspended between said parallel support beams;

means for releasably supporting one end of said ceiling tiles on said first support beam;

said tiles having kerfs along opposite edges thereof extending between said first and second support beams;

spline means in said kerfs and extending between adjacent tiles, said spline means having means for supporting said spline means on said second support beam so that said tiles are supported at an end opposite said one end through the spline means;

at least one of said tiles being cut away above said kerf along a portion of each side of said one tile and forming an opening above said kerf; and said spline means including a movable member slidable between a locking position engaging the kerf at the side of one tile and a release position at said cut-away portion of said one tile, said movable member having a flange which engages said kerf of said one tile and sized to pass through said opening when said movable member is in said release position to permit said one tile to be removed from said ceiling when the movable members are moved to the release position at each side of one tile.

2. A removable ceiling construction according to claim 1 wherein said cut-away portion of said kerf is adjacent said one end of said one tile.

3. A suspended ceiling construction according to claim 1 wherein said tiles have a lip at said opposite end which abuts and conceals said second support means.

4. A suspended ceiling construction according to claim 2 wherein said spline means comprises an L-shaped flange which is positioned on said second support means and projects into the kerf of the tile adjacent said one tile; and said movable member is slidably mounted on said L-shaped spline.

5. A suspended ceiling construction according to claim 2 wherein said spline includes a bar supported by said first and second support beams, and said movable member is slidably supported by said bar.

6. A suspended ceiling construction according to claim 5 wherein said movable member has laterally projecting flanges extending into a kerf of said one tile and a kerf of a tile adjacent thereto.

7. A suspended ceiling construction according to claim 1 wherein said spline means comprises an L-shaped flange which is positioned on said second support means and projects into the kerf at the tile adjacent said one tile; and said movable member is slidably mounted on said L-shaped spline.

8. A suspended ceiling construction according to claim 7 wherein the L-shaped flange also is positioned at least partially on said first support means.

9. A suspended ceiling construction according to claim 7 and further comprising means to prevent upward movement of said movable member with respect to said L-shaped spline.

10. A suspended ceiling construction according to claim 1 wherein said spline means includes a bar supported by said first and second support means and said movable member is slidably supported by said bar.

11. A suspended ceiling construction according to claim 10 wherein said movable member has laterally projecting flanges extending into a kerf of said one tile and a kerf of a tile adjacent thereto.

12. A suspended ceiling construction according to claim 1 wherein the spline means is supported on said first support beam as well as the second support beam, such that the tiles are supported at both ends by the spline means.

* * * * *

Disclaimer 3,988,871.—*Henry Moomey*, Kentwood, Mich. SUSPENDED CEILING CONSTRUCTION. Patent dated Nov. 2, 1976. Disclaimer filed Apr. 25, 1977, by the inventor.

Hereby enters this disclaimer to the entire term of said patent.

[*Official Gazette July 12, 1977.*]